US005540573A

United States Patent [19]

Arbogast et al.

[11] Patent Number: 5,540,573

[45] Date of Patent: Jul. 30, 1996

[54] SICKLELESS INTERNAL GEAR PUMP HAVING SEALING ELEMENTS IN TOOTH HEADS

[75] Inventors: Franz Arbogast; Peter Peiz, both of Heidenheim, Germany

[73] Assignee: J.M. Voith GmbH, Heidenheim, Germany

[21] Appl. No.: 356,980

[22] Filed: Dec. 16, 1994

[30] Foreign Application Priority Data

Dec. 17, 1993 [DE] Germany ..... 43 43 193.3

[51] Int. Cl.[6] ..... F04C 2/10; F04C 15/00

[52] U.S. Cl. ..... 418/124; 418/168

[58] Field of Search ..... 418/112, 113, 418/122–124, 166–168, 171

[56] References Cited

U.S. PATENT DOCUMENTS

| | | | |
|---|---|---|---|
| 748,348 | 12/1903 | Cooley | 418/166 |
| 2,790,394 | 4/1957 | Mori | 418/168 |
| 2,866,417 | 12/1958 | Nubling | 418/171 |
| 3,306,226 | 2/1967 | Walter | 418/171 |
| 3,429,269 | 2/1969 | Walter | 418/171 |
| 3,619,089 | 11/1971 | Pierrat | 418/124 |
| 5,135,371 | 8/1992 | Arbogast | 418/124 |
| 5,354,188 | 10/1994 | Arbogast et al. | 418/132 |

FOREIGN PATENT DOCUMENTS

| | | |
|---|---|---|
| 0563661 | 3/1993 | European Pat. Off. . |
| 3633330 | 4/1988 | Germany . |
| 4104397 | 9/1991 | Germany . |
| 4140293 | 6/1993 | Germany . |

*Primary Examiner*—John J. Vrablik
*Attorney, Agent, or Firm*—Baker & Daniels

[57] ABSTRACT

The invention is directed to a sickleless internal gear pump with an internal ring gear and a pinion meshing with the ring gear. The ring gear has radial apertures for the medium being pumped, and sealing elements radially movably disposed in an appropriate profile groove, and inserted in respective tooth heads of the ring gear, or in the tooth heads of the pinion. The sealing elements are able to slide on the opposite tooth heads of the pinion, or of the ring gear. The head shape of the sealing element and the shape of the tooth space bottom of the ring gear, or of the pinion, are configured such that the sealing element establishes a seal between the pressure space and the suction space in the area of dead center.

2 Claims, 2 Drawing Sheets

SICKLELESS INTERNAL GEAR PUMP HAVING SEALING ELEMENTS IN TOOTH HEADS

BACKGROUND OF THE INVENTION

The invention is directed to a sickleless internal gear pump for generating high pressure.

Internal gear pumps of a type known, e.g., from DE 41 04 397 A1 generally have an internal ring gear with which meshes an external pinion in driving fashion. The pinion has one tooth less than the ring gear and is arranged eccentric to the ring gear in such a way that always the outside of a tooth head on the pinion to contact the inside of a tooth head on the ring gear. Gear pumps of this type additionally have a suction port in the area in which the teeth disengage as the pinion rotates. Analogously, they feature a pressure port on the side opposite the suction port, where the teeth mesh again. This assures the feeding of pressure medium into or out of the interior of the ring gear, through essentially radial apertures. These apertures originate from the shell surface of the ring gear and empty in its tooth bottom.

The circumference of the ring gear divides thus into a suction space, in which the pressure medium is by the suction port sucked through the apertures, and in a pressure space, in which the pressure medium is through the apertures forced outward from the interior of the ring gear. These two areas are in the tooth engagement separated by the so-called dead center of the toothing.

On the sickleless internal gear pump known from DE 41 04 397 A1, the flank seal of a pinion tooth with the relevant ring gear tooth ends, due to the small number of teeth, far before dead center of the toothing. The area from the limit point of the flank seal up to dead center is part of the pressure space in which, thus, pressure medium is being pumped. This residual quantity of pressure medium also should be pumped into the pressure space, since otherwise the specific delivered volume diminishes appreciably. (Compare to theoretical q).

The missing seal on the tooth flank results in a deterioration of the volumetric efficiency. What is needed in the art is a sickleless internal gear pump with involute teeth (i.e., with a large angle of engagement in operation), with which the theoretical, specific delivery volume is being pumped without encountering volumetric efficiency losses.

SUMMARY OF THE INVENTION

The present invention provides a sealing element which is configured, as regards its head shape, so that it interacts with the bottom shape of the tooth space of the ring gear, respectively of the pinion, in sealed fashion. This sealing effect is given through the sealing element in conjunction with the tooth space bottom in the area of the dead space. In addition to this sealing effect there exists also the sealing effect due to the tooth flanks that bear on one another, so that the inventional pump boasts an enlarged area of the pressure space with a good sealing effect. This expansion of the sealing effect area results in an improved efficiency of the pump, since inventionally more pressure medium proceeds now with good sealing effect from the pressure space to the pressure port.

An advantage of the present invention is that the improved efficiency is achieved without additional increase in manufacturing expense.

A further embodiment of the invention provides for passing the pressure medium by way of axial grooves to the backside of the sealing elements.

These axial grooves are arranged in the casing part in which the pinion is rotatably mounted or, in the pump design with axial compensation, in the axial washers. The axial grooves assure that the radial sealing elements will be forced onto the bottom of the relevant tooth space.

BRIEF DESCRIPTION OF THE DRAWINGS

The invention will be illustrated hereafter with the aid of the attached drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
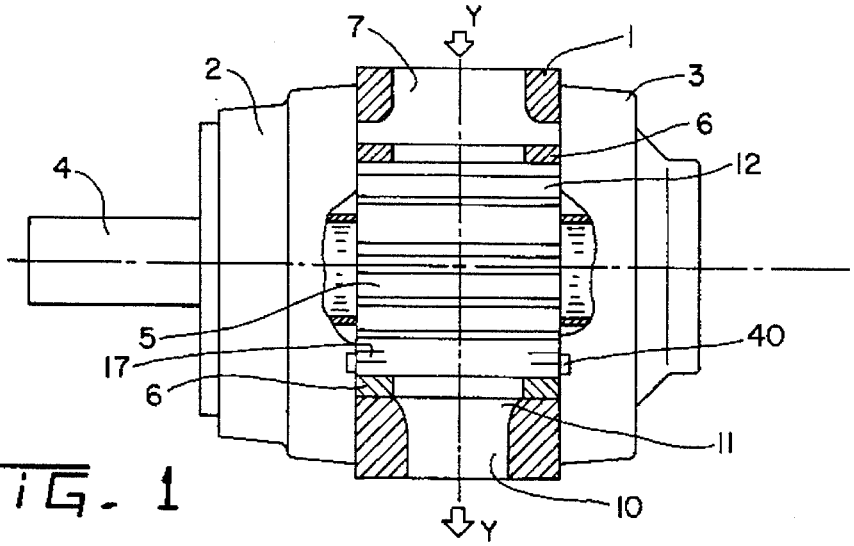
FIG. 1 is a side sectional view of an embodiment of an internal gear pump of the present invention.

Referring now to the drawings, and particularly to FIG. 1, an internal gear pump includes a casing having a casing center part 1 and casing side parts 2, 3. The two casing side parts 2, 3 enclose in sealing fashion the casing center part 1, in the interior of which an internally toothed ring gear 6 is arranged along with an externally toothed pinion 5. Pinion 5 is mounted on a drive shaft 4 and drives the ring gear by way of its teeth 12, which mesh with teeth 12' of ring gear 6. Pinion 5 and ring gear 6 are not coaxial, but eccentric to each other. Furthermore, pinion 5 has one tooth less than ring gear 6, so that always the outside of a tooth head 13 on pinion 5 makes contact with the inside of a tooth head 14 on ring gear 6. Visible in casing center part 1 is also a suction port 7, in the area in which teeth 12 of pinion 5 and teeth 12' of ring gear 6 disengage while rotating in the direction of arrow X. Contained in the side of casing center part 1 opposite suction port 7 is a pressure port 10 which is disposed in the area in which teeth 12 of pinion 5 and teeth 12' of ring gear 6 mesh again. The medium inflow from the suction port 7 to the interior of the pump and from there to the pressure port 10 takes place through apertures 17, which originate from the shell surface of ring gear 6 and empty in the bottom of a tooth space of internal gear 6.

The medium flow is indicated by arrow Y. In the area of the meshing tooth heads 13, 14, the casing parts 2, 3 feature axial grooves 40 (FIG. 1).

Figure 2:
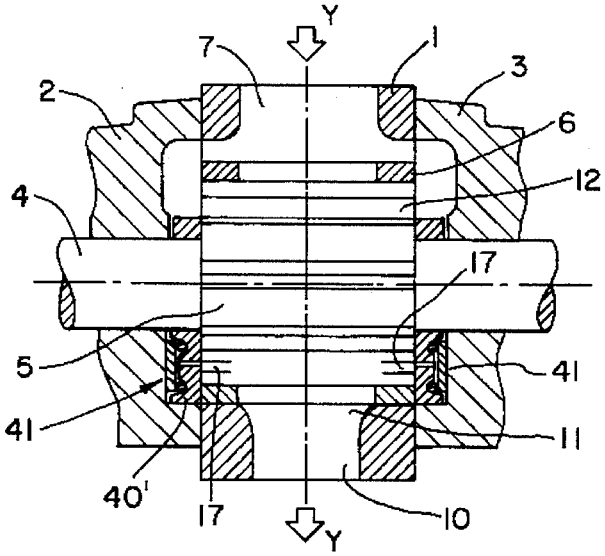
FIG. 2 is a side elevational view of an embodiment of internal gear pump of the present invention having an axial washer for equalization of axial play.

Referring now to FIG. 2, axial grooves 40' may include axial washers 41 of a type known from U.S. Pat. No. 5,354,188 for equalization of axial play.

Figure 3:
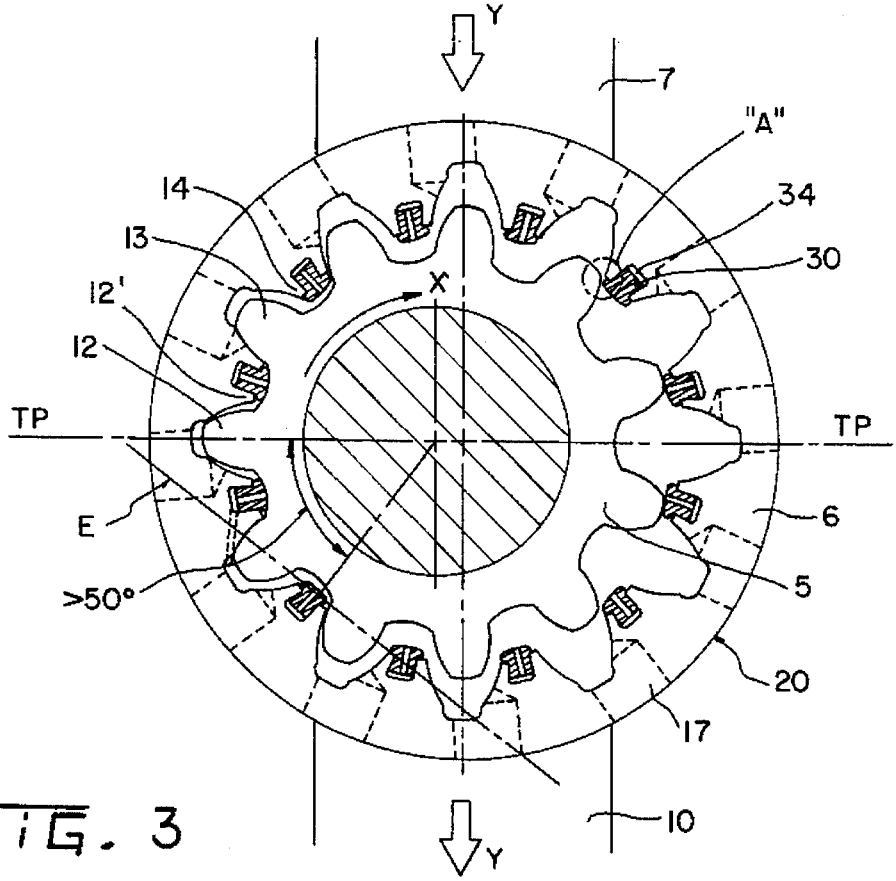
FIG. 3 is a sectional end view through the internal gear pump, the area of the pinion and the ring gear for either of the embodiments shown in FIGS. 1 and 2.

Referring now to FIG. 3, dead center (TP) of the toothing (12,12') marks the end of the pinion teeth penetration into ring gear teeth 12'. Owing to the small number of teeth, presently 11 teeth of the pinion 5, as compared to 12 teeth of the ring gear 6, an angle of engagement of the involute toothing of more than 50° is operationally obtained, which is indicated by the so-called line of engagement E.

Figure 4:
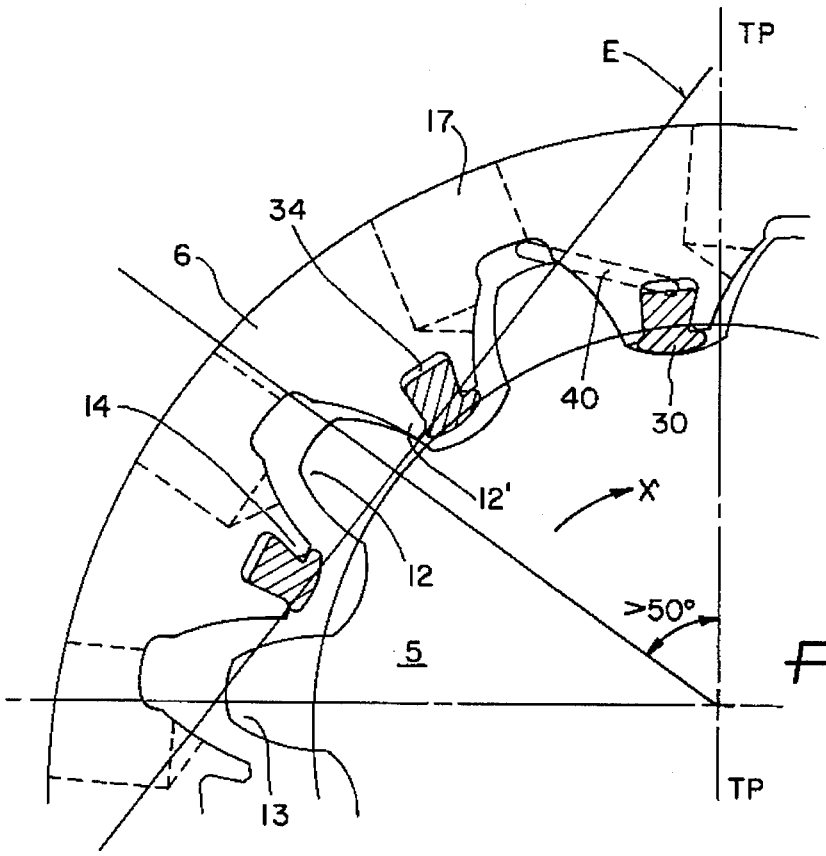
FIG. 4 is an enlarged fragmentary, sectional view of the toothing in the area of dead center.

FIG. 4 is an enlarged section of FIG. 3 in which tooth heads 13, 14 engage the tooth spaces between pinion 5, respectively of ring gear 6. The tooth heads 14 of ring gear 6 feature a mushroom-shaped sealing element whose cross-sectional shape is adapted to the shape of the tooth space bottom of pinion 5. The mushroom-shaped sealing element 30 is disposed in a radial profile groove 34 so arranged that it is radially movable with a certain play. The head of the sealing element 30 is convex, thereby assuring in conjunction with the slightly concave shape of the tooth space bottom a good sealing effect. This sealing effect of sealing element 30 with the tooth space bottom occurs in addition to the sealing between the flanks of tooth heads 13 of pinion 5 relative to tooth heads 14 of ring gear 6 in their advance. The area in which the flank seal is effective, viewed in the direction of rotation X, ends already before the dead center TP, hence within the pressure area. Effective in this part of the pressure area, in which no flank sealing occurs, is solely the sealing effect provided by sealing element 30 in conjunction with the tooth space bottom. This area inventionally now being available for utilization, the delivered volume of pumping medium, and thus the efficiency of the pump, is being raised.

Indicated schematically, in FIG. 4, is also an axial groove 40 in the casing part 2 or 3, to which the pumping medium is admitted from the pressure area and through which a defined pressing down of the sealing element 30 onto the tooth space bottom of pinion 5 can be accomplished.

The same as in FIG. 3, dead center TP of the toothing is illustrated in FIG. 4 with the angle of engagement of more than 50° as defined by the line of engagement E.

Figure 5:
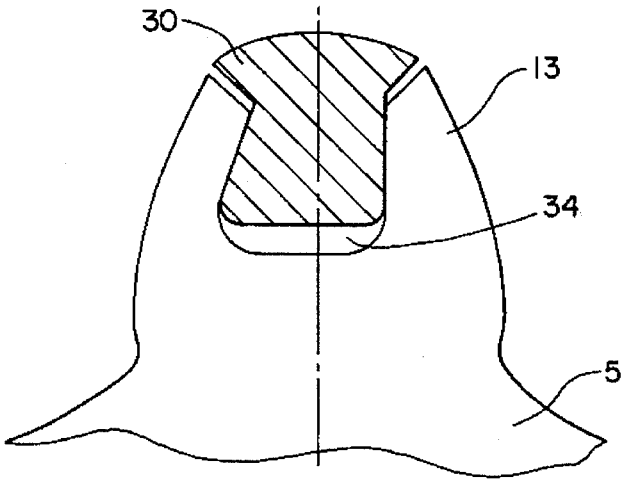
FIG. 5 is an enlarged sectional view of a pinion tooth head having a sealing element.

Although the preceding description discloses with the aid of FIG. 4 the combination of sealing element 30 in tooth heads 14 of ring gear 6 sealed with the tooth space bottom of pinion 5, it is also possible to analogously provide a sealing element in tooth heads 13 of pinion 5, as shown in FIG. 5, in conjunction with the tooth space bottom of ring gear 6.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

We claim:

1. A sickleless internal gear pump, comprising:

a casing having a suction port and a pressure port, and defining a suction space and a pressure space, said casing further having an inner chamber;

an internally toothed ring gear and a pinion meshing with said ring gear, said ring gear and said pinion rotatably carried within said chamber of said casing and having a plurality of tooth heads and a tooth space bottom between adjacent said tooth heads, each said tooth head of one of said ring gear and said pinion including a profile groove therein, each of said ring gear tooth heads, pinion tooth heads and inner chamber having an axial length which is substantially the same;

a plurality of sealing elements being radially movably disposed in respective said profile grooves, said sealing elements having a head and being able to slide on an opposing tooth head of said pinion and ring gear;

wherein each said sealing element head and said tooth space bottom of an opposing ring gear and pinion are mutually configured such that respective ring gear and pinion teeth are in contact and a seal is established by said sealing element only in the area of dead center between said pressure space and said suction space.

2. The sickleless internal gear pump of claim 1, wherein said casing includes an axial groove communicating the pressure space with said profile groove in said area of dead center for biasing said sealing elements into engagement with said tooth space bottoms.

* * * * *